US007749103B2

(12) United States Patent
Nakano

(10) Patent No.: US 7,749,103 B2
(45) Date of Patent: Jul. 6, 2010

(54) GOLF CLUB HEAD

(75) Inventor: Takashi Nakano, Kobe (JP)

(73) Assignee: SRI Sports Limited, Kobe (JP)

( * ) Notice: Subject to any disclaimer, the term of this patent is extended or adjusted under 35 U.S.C. 154(b) by 121 days.

(21) Appl. No.: 12/230,227

(22) Filed: Aug. 26, 2008

(65) Prior Publication Data

US 2009/0069113 A1 Mar. 12, 2009

(30) Foreign Application Priority Data

Sep. 6, 2007 (JP) ..... 2007-231765

(51) Int. Cl.
*A63B 53/04* (2006.01)

(52) U.S. Cl. ..... 473/345; 473/349

(58) Field of Classification Search ..... 473/324–350
See application file for complete search history.

(56) References Cited

U.S. PATENT DOCUMENTS 6,575,845 B2 * 6/2003 Galloway et al. ..... 473/329
6,663,504 B2 * 12/2003 Hocknell et al. ..... 473/329
6,875,126 B2 * 4/2005 Yabu ..... 473/305
6,881,159 B2 * 4/2005 Galloway et al. ..... 473/345
6,955,612 B2 * 10/2005 Lu ..... 473/324
6,969,326 B2 * 11/2005 De Shiell et al. ..... 473/345
7,059,973 B2 * 6/2006 Erickson et al. ..... 473/345
7,066,835 B2 * 6/2006 Evans et al. ..... 473/346
7,128,662 B2 * 10/2006 Kumamoto ..... 473/345
7,128,664 B2 * 10/2006 Onoda et al. ..... 473/347
7,175,541 B2 * 2/2007 Lo ..... 473/345
7,189,165 B2 * 3/2007 Yamamoto ..... 473/248
7,252,599 B2 * 8/2007 Hasegawa ..... 473/329
7,258,630 B2 * 8/2007 Erickson et al. ..... 473/345
7,261,645 B2 * 8/2007 Oyama ..... 473/345
7,261,646 B2 * 8/2007 De Shiell et al. ..... 473/345
7,273,419 B2 * 9/2007 Evans et al. ..... 473/328
7,281,993 B2 * 10/2007 Oyama ..... 473/345
7,281,994 B2 * 10/2007 De Shiell et al. ..... 473/345
7,297,074 B2 * 11/2007 Kumamoto ..... 473/345
7,311,614 B2 * 12/2007 Kumamoto ..... 473/345
7,371,191 B2 * 5/2008 Sugimoto ..... 473/345
7,396,291 B2 * 7/2008 Lo ..... 473/324

(Continued)

FOREIGN PATENT DOCUMENTS

JP 2002301174 A * 10/2002

(Continued)

*Primary Examiner*—Alvin A Hunter
(74) *Attorney, Agent, or Firm*—Birch, Stewart, Kolasch & Birch, LLP

(57) ABSTRACT

A golf club head having a hollow structure comprising a head main body provided with a top opening and a crown plate fitted in the top opening is disclosed. The head main body is provided with a support for the crown plate extending along the edge of the top opening and protruding into the top opening with a variable width from the edge of the top opening. the average Wa of the width of the crown plate support existing in the foreside one-quarter zone of the top opening, the average Wc of the width of the crown plate support existing in the backside one-quarter zone of the top opening, and the average Wb of the width of the crown plate support existing in the mid two-quarter zone of the top opening satisfy (1) Wa>Wb, and (2) Wc>Wb.

7 Claims, 6 Drawing Sheets

U.S. PATENT DOCUMENTS

| | | | | |
|---|---|---|---|---|
| 7,396,297 | B2 * | 7/2008 | Hirano | 473/345 |
| 7,399,237 | B2 * | 7/2008 | Evans et al. | 473/328 |
| 7,435,190 | B2 * | 10/2008 | Sugimoto | 473/345 |
| 7,452,287 | B2 * | 11/2008 | Erickson et al. | 473/345 |
| 7,479,070 | B2 * | 1/2009 | Hirano | 473/345 |
| 7,494,425 | B2 * | 2/2009 | De Shiell et al. | 473/345 |
| 7,559,853 | B2 * | 7/2009 | Hirano | 473/324 |
| 7,578,756 | B2 * | 8/2009 | Erickson et al. | 473/342 |
| 2007/0099727 | A1 * | 5/2007 | Sugimoto | 473/345 |
| 2009/0247313 | A1 * | 10/2009 | Nakano | 473/290 |

FOREIGN PATENT DOCUMENTS

| | | | | |
|---|---|---|---|---|
| JP | 2003245382 | A | * | 9/2003 |
| JP | 2004159854 | A | * | 6/2004 |
| JP | 2004167127 | A | * | 6/2004 |
| JP | 2005052458 | A | * | 3/2005 |
| JP | 2005065774 | A | * | 3/2005 |
| JP | 2006020817 | A | * | 1/2006 |
| JP | 2007125242 | A | * | 5/2007 |
| JP | 2008000605 | A | * | 1/2008 |

* cited by examiner

E 1 section

GOLF CLUB HEAD

BACKGROUND OF THE INVENTION

The present invention relates to a golf club head, more particularly to a joint structure between a crown plate and a head main body capable of reducing the weight of the head in its crown portion while maintaining or improving the joint strength and durability.

In the US patent application publication US-2007-099727-A1, a golf club head having a hollow structure is disclosed. The hollow structure comprises a head main body provided with a top opening and a crown plate covering the opening and having a smaller specific gravity, wherein in order to support the crown plate fitted in the opening, a support for the crown plate (hereinafter "crown plate support") protrudes into the opening. In a preferable example, the width (or amount of protrusion) of the crown plate support is increased on the clubface side but decreased on the rear side.

If such a crown plate support is decreased in the width, the bonding strength between the crown plate support and the crown plate is decreased, therefore, the above-mentioned example has a tendency that the durability becomes insufficient in the rear part of the crown portion.

SUMMARY OF THE INVENTION

It is therefore, an object of the present invention to provide a golf club head, in which the weight of the crown plate support is minimized, without deteriorating the joint strength and durability.

According to the present invention, a golf club head has a hollow structure comprising a head main body provided with a top opening in a crown portion and a crown plate fitted in the top opening so as to close the top opening, wherein the head main body is provided with a crown plate support, the crown plate support extending along the edge of the top opening and protrudes into the top opening with a variable width from the edge of the top opening so as to support the peripheral part of the inner surface of the crown plate, wherein the average Wa of the width of the crown plate support existing in a foreside one-quarter zone of the top opening, the average Wc of the width of the crown plate support existing in a backside one-quarter zone of the top opening, and the average Wb of the width of the crown plate support existing in a mid two-quarter zone of the top opening satisfy the following conditional expressions (1) and (2):

$$Wa>Wb \quad (1)$$

$$Wc>Wb \quad (2)$$

Here, the width (W) of the crown plate support is defined as measured perpendicularly to a tangent to the edge Oe of the top opening O1. As shown in FIG. 6, the average (Wa, Wb, Wc) of the width W of the crown plate support 10*b* is obtained by $$\Sigma\{W(i)\times n(i)\}/\Sigma n(i),\ (i=1, 2, \ldots)$$

wherein

W(i) is the width W of a small region (i) of the crown plate support (10*b*), n(i) is the length of the small region (i) measured at the midpoint of the width W along the center line V.

DEFINITIONS

In this specification, sizes, positions, directions and the like relating to the club head refer to those under a standard state of the club head unless otherwise noted.

Here, the standard state of the club head is such that the club head is set on a horizontal plane HP so that the axis CL of the club shaft is inclined at the lie angle (beta) while keeping the axis CL on a vertical plane VP, and the club face 2 forms its loft angle (alpha) with respect to the horizontal plane HP. Incidentally, in the case of the club head alone, the center line of the clubshaft inserting hole of the hosel can be used instead of the axis CL of the clubshaft.

"Sweet spot SS" is the point of intersection between the club face 2 and a straight line N drawn normally to the club face 2 passing through the center of gravity G of the head.

"Back-and-forth direction" is a direction parallel with the straight line N projected on the horizontal plane HP.

"Heel-and-toe direction" is a direction parallel with the horizontal plane HP and perpendicular to the back-and-forth direction.

"Up-and-down direction" is a direction perpendicular to the horizontal plane HP.

"Lateral moment of inertia" is the moment of inertia of the head around a vertical axis passing through the center of gravity G.

"Vertical moment of inertia" is the moment of inertia of the head around a horizontal axis passing through the center of gravity G in parallel to the toe-heel direction of the head.

"Gravity point height" is the distance in the up-and-down direction measured from the horizontal plane HP to the center of gravity G of the head.

"Edge" of the club face 2: If the edge (2*a*, 2*b*, 2*c* and 2*d*) is unclear due to smooth change in the curvature of the club face 2, a virtual edge line (Pe) which is defined based on the curvature change, is used instead as follows. As shown in FIGS. 7(*a*) and 7(*b*), in each cutting plane E1, E2 - - - including the straight line N extending between the sweet spot SS and the center of gravity G, a point Pe at which the radius (r) of curvature of the profile line Lf of the face portion first becomes under 200 mm in the course from the center SS to the periphery of the club face is determined. Then, the virtual edge line is defined as a locus of the points Pe.

"Area So of the crown plate 1B" is the area of the crown plate 1B projected on the horizontal plane HP under the standard state of the head as shown in FIG. 2.

"Area Sc of the crown portion 4" is fundamentally the area of the crown portion 4 projected on the horizontal plane HP. Practically, however, it can be defined as the projected area of the head in the top view thereof under the standard state as shown in FIG. 2 which is surrounded by the upper edge 2*a* of the club face 2 and the profile line 6*a* of the side portion 6 of the head (inclining the hosel portion 7).

"Wood-type golf club" is meant for at least number 1 to 5 woods, and clubs comprising heads having similar shapes may be included.

DESCRIPTION OF THE PREFERRED EMBODIMENTS

Figure 1:
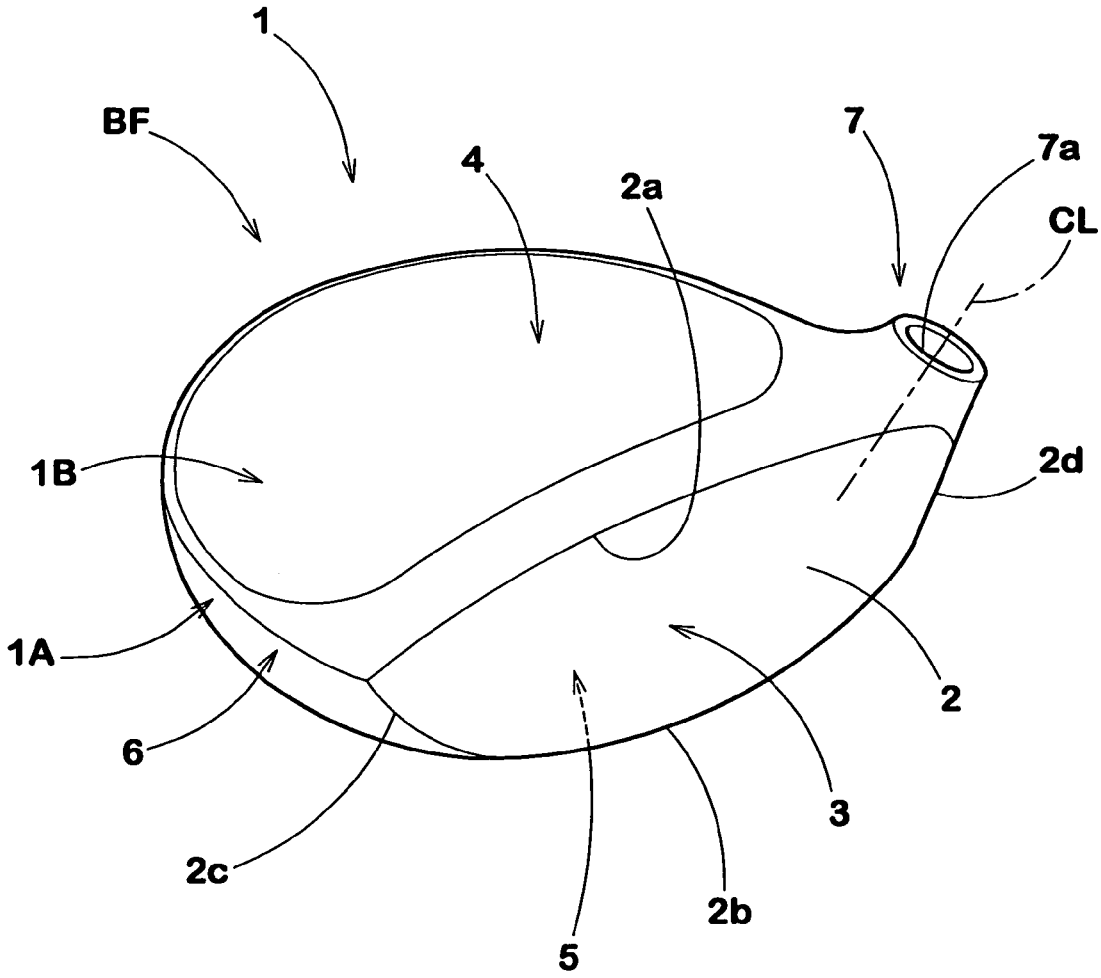
FIG. 1 is a perspective view of a wood-type golf club head according to the present invention.
Figure 2:
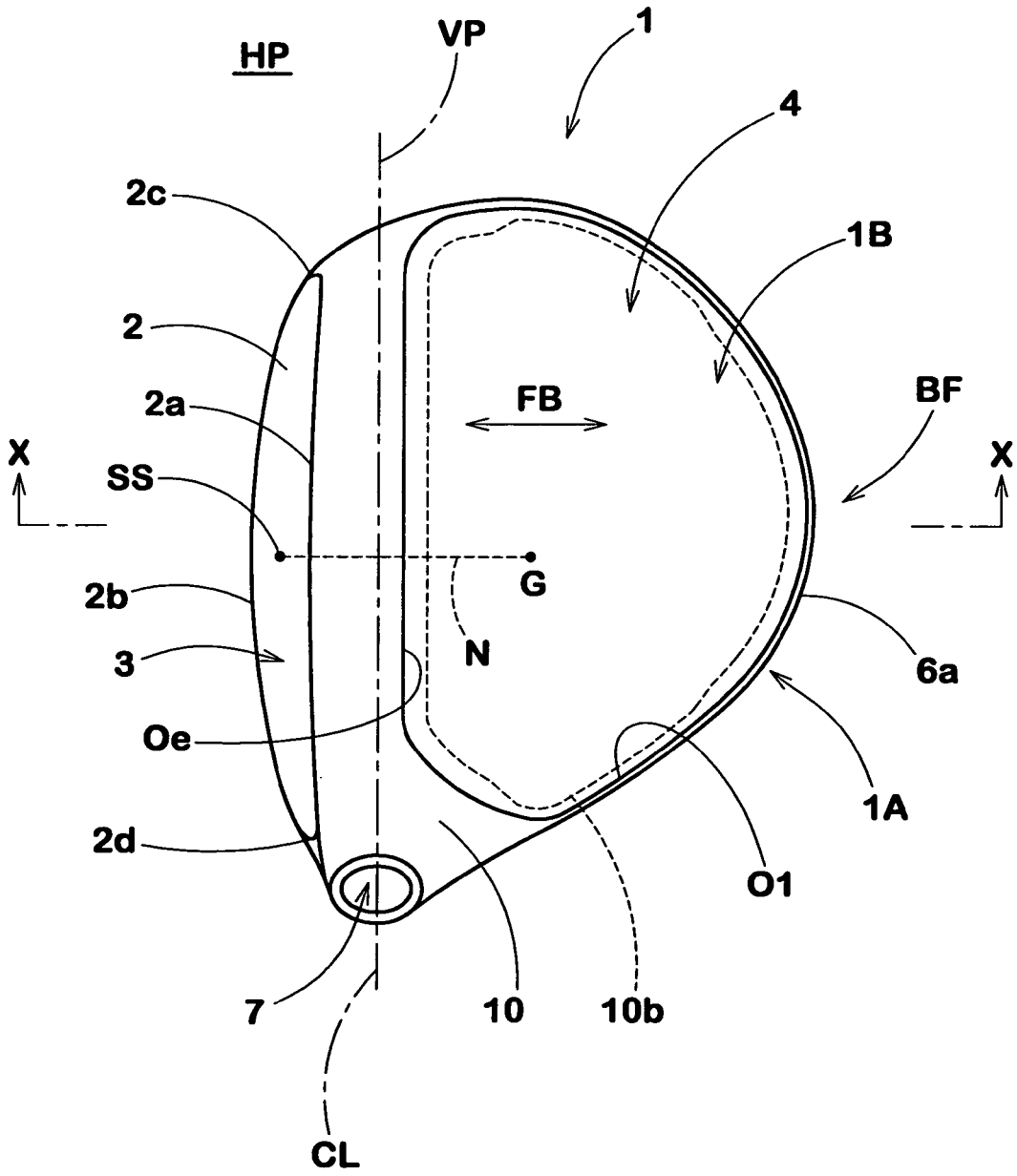
FIG. 2 is a plan view thereof.

Embodiments of present invention will now be described in detail in conjunction with accompanying drawings.

In the drawings, golf club head 1 according to the present invention comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hosel portion 7 at the heel side end of the crown to be attached to an end of a club shaft (not shown) inserted into the shaft inserting hole 7*a*. Thus, the club head 1 is provided with a hollow (i) and a shell structure with the thin wall.

In this embodiment, the head 1 is a wood-type head.

The volume of the club head 1 is preferably set in a range of not less than 80 cc, more preferably not less than 90 cc, still more preferably not less than 100 cc in order to increase the moment of inertia of the club head 1 to improve the directionality of the hit ball. However, to avoid an excessive increase in the club head weight and deteriorations of swing balance and durability, the head volume is preferably not more than 460 cc.

The mass of the club head 1 is preferably set in a range of not less than 150 g, more preferably not less than 160 g, still more preferably not less than 170 g, but not more than 300 g, more preferably not more than 270 g, still more preferably not more than 250 g.

Figure 3:
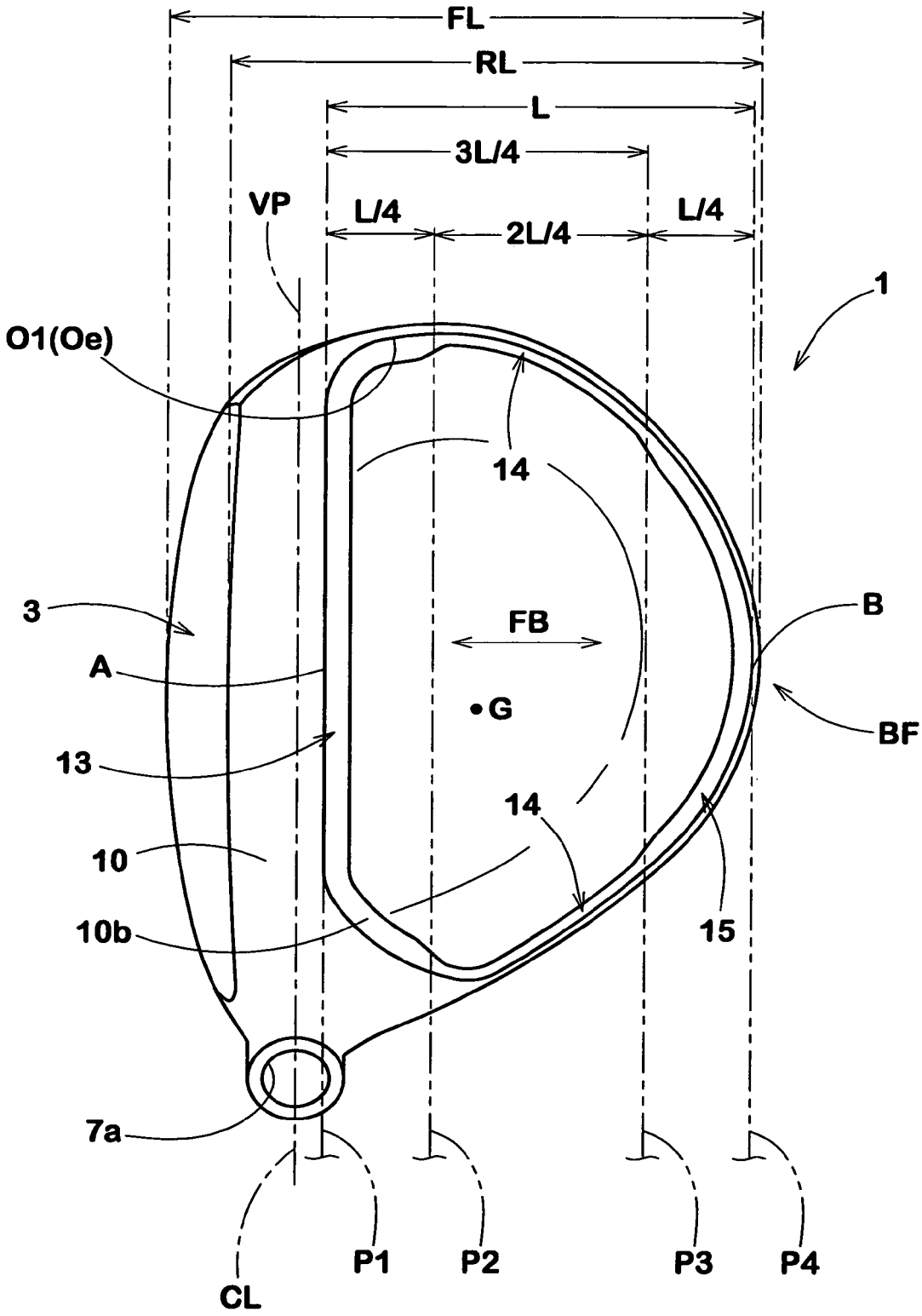
FIG. 3 is a plan view of the club head from which the crown plate is removed.

Further, as shown in FIG. 3, in the plan view of the head under the standard state, the maximum size FL of the club head 1 in the back-and-forth direction is preferably set in a range of not less than 70 mm, more preferably not less than 75 mm, still more preferably not less than 80 mm, but not more than 120 mm, more preferably not more than 110 mm, still more preferably not more than 100 mm. If the maximum size FL is too small, the vertical moment of inertia becomes decreased, and the directionality is deteriorated. If the maximum size FL is too large, there is a tendency that the user feels odd when addressing the ball.

Furthermore, the maximum size RL of the crown portion 4 in the back-and-forth direction is preferably set in a range of not less than 50 mm, more preferably not less than 55 mm, still more preferably not less than 60 mm, but not more than 100 mm, more preferably not more than 95 mm, still more preferably not more than 90 mm. If the maximum size RL is too small, a sense of easy when addressing the ball is lessened. If the maximum size RL is too large, there is a tendency that the user feels odd when addressing the ball.

The club head 1 in this example is composed of a hollow main body 1A, a crown plate 1B, and a face plate 1C. The main body 1A is provided with a single top opening O1 and a single front opening O2. The top opening O1 is closed by the crown plate 1B. The front opening O2 is closed by the face plate 1C. Thus, a closed cavity is formed.

In order to lower and deepen the center of gravity G of the head, the main body 1A is made of a metal material having a largest specific gravity Sg1. And the crown plate 1B and face plate 1C are each made of a material having a specific gravity smaller than the head main body 1A.

It is not essential but preferable that the specific gravity Sg1 of the head main body 1A is set in a range of not less than 2.8, more preferably not less than 4.0, still more preferably not less than 4.4. But, in view of the club head weight and volume, the specific gravity Sg1 is preferably not more than 10.0, more preferably not more than 8.0, still more preferably not more than 7.8.

Specifically, stainless alloys and maraging steels can be used suitably for the head main body 1A.

Preferably, the specific gravity Sg2 of the crown plate 1B and the specific gravity Sg3 of the face plate 1C are each set in a range of not less than 1.0, more preferably not less than 1.8, still more preferably not less than 2.8, most preferably not less than 4.0. If less than 1.0, it is difficult to provide a sufficient strength. If the specific gravity Sg2, Sg3 is too large, on the other hand, it becomes difficult to lower and deepen the center of gravity G of the head. Therefore, the specific gravity Sg2, Sg3 is preferably set in a range of not more than 8.0, more preferably not more than 7.9, still more preferably not more than 5.0.

For the crown plate 1B, for example, fiber reinforced resins (specific gravity about 1.4), titanium alloys (specific gravity about 45), aluminum alloys (specific gravity about 2.7), and magnesium alloys (specific gravity about 1.8) can be used suitably.

For the face plate 1C for which a larger specific tensile strength is required, titanium alloys (e.g. Ti-15V-6Cr-4Al, Ti-6Al-4V, Ti-13V-11Cr-3Al, Ti-5.5Al-1Fe, Ti-4.5Al-3V-2Fe-2Mo, Ti-4.5Al-2Mo-1.6V-0.5Fe and the like) can be used suitably.

In order to facilitate an effective weight reduction of the crown portion 4 while securing a sufficient strength of the crown plate 1B, it is preferred that the ratio (Sg2/Sg1) of the specific gravity Sg2 of the crown plate 1B and the specific gravity Sg1 of the head main body 1A is set in a range of not less than 0.20, more preferably not less than 0.30, still more preferably not less than 0.50, but not more than 0.80, more preferably not more than 0.75, still more preferably not more than 0.70.

The thickness t4 of the face plate 1C is preferably not less than 1.5 mm, more preferably not less than 2.0 mm in order to provide a sufficient durability for the face portion 3. But, in order to avoid an excessive increase in the weight of the face portion 3, the thickness t4 is preferably not more than 4.0 mm, more preferably not more than 3.0 mm. The thickness t4 may be constant, but in this example, the face plate 1C has a variable thickness t4 which is larger in the central region around the sweet spot than the surrounding peripheral region.

The thickness t3 of the crown plate 1B is preferably not more than 2.5 mm, more preferably not more than 2.0 mm in order to decrease the weight of the crown portion 3. In the case that the crown plate 1B is made of a metal material having the same specific gravity as the head main body 1A, for example, a thin plate having a thickness of 1.0 mm or less obtained by rolling can be used. In any case, in order to provide a sufficient durability and strength, the thickness t3 of the crown plate 1B is set in a range of not less than 0.3 mm, more preferably not less than 0.4 mm.

The thickness t5 of the sole portion 5 is set to be more than the thickness t3 of the crown plate 1B, and the difference therebetween is set in a range of more than 0.5 mm, preferably more than 0.7 mm, more preferably more than 1.0 mm. But, to avoid an excessive increase of the club head weight, the thickness t5 of the sole portion 5 is preferably not more than 5.5 mm, more preferably not more than 5.0 mm.

In order to achieve both of the weight reduction in the crown portion 4 and the rigidity of the head main body 1A, the ratio (So/Sc) of the area so of the crown plate 1B and the area Sc of the crown portion is preferably set in a range of not less than 0.50, more preferably not less than 0.60, still more preferably not less than 0.70, but not more than 0.99, more preferably not more than 0.98, still more preferably not more than 0.95.

Preferably, the area Sc of the crown portion 4 is set in a range of not less than 40 sq. cm, more preferably not less than 45 sq. cm, still more preferably not less than 50 sq. cm, but not more than 100 sq. cm, more preferably not more than 90 sq. cm, still more preferably not more than 80 sq. cm.

The area So of the crown plate 1B is preferably set in a range of not less than 30 sq. cm, more preferably not less than 35 sq. cm, still more preferably not less than 40 sq. cm. But, not to excessively decrease the rigidity of the head main body 1A, the area So of the crown plate 1B is preferably not more than 80 sq. cm, more preferably not more than 75 sq. cm, still more preferably not more than 70 sq. cm.

As to the shapes of the top and front openings O1 and O2, it is not critical but preferable that the shapes are defined by a smoothly curved line without angled corners, and that the shapes are similar to but smaller than the contour shapes of the crown portion 4 and face portion 3, respectively. The front opening O2 dose not protrude from the face portion 3. In other words, the front opening O2 is positioned within the face portion 3. Thus, an annular face periphery part 11 surrounding the front opening O2 is formed in the face portion 3. The top opening O1 is positioned within the crown portion 4. Thus, an annular crown periphery part 10 surrounding the top opening O1 is formed in the crown portion 4.

Figure 4:
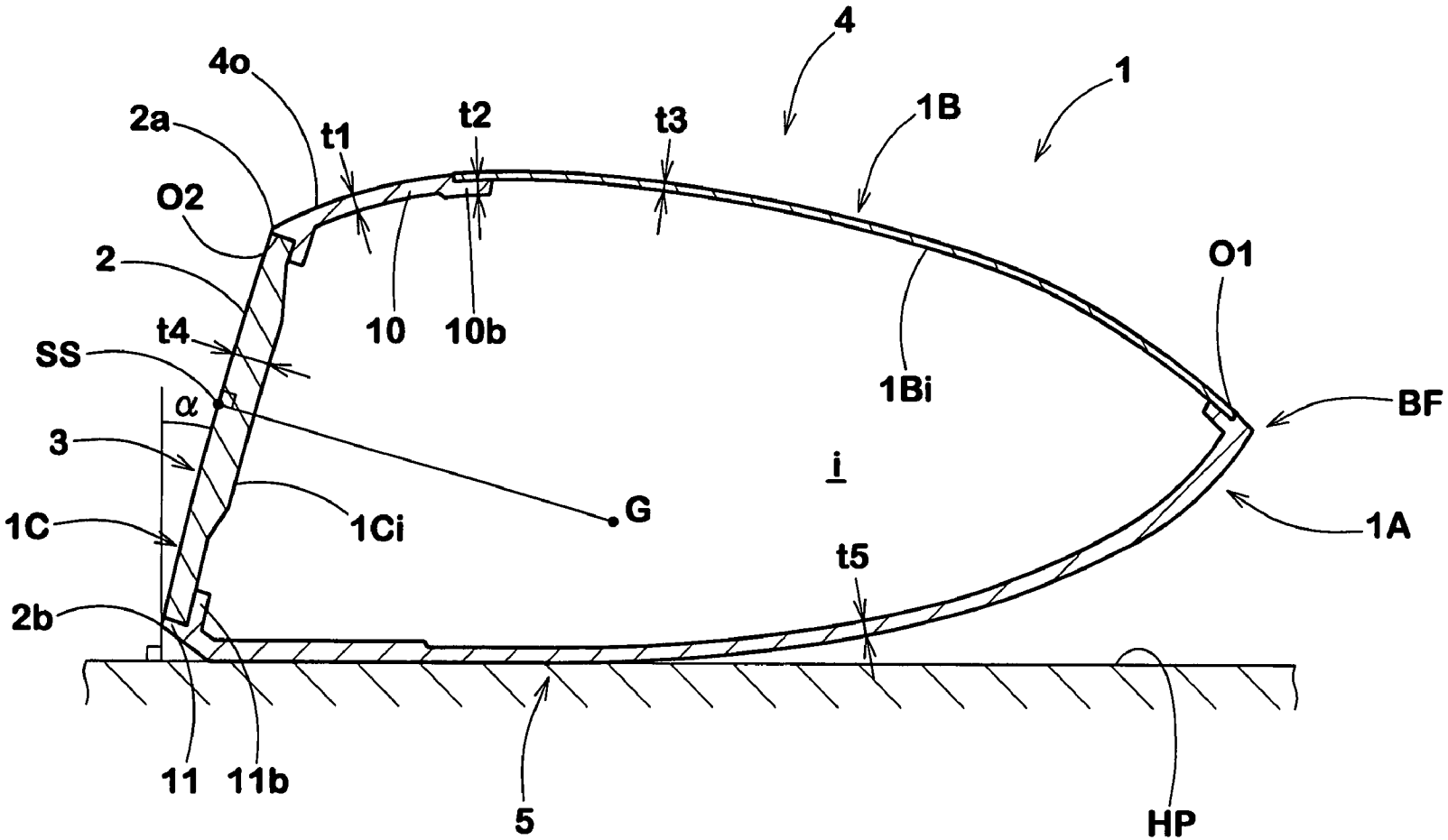
FIG. 4 is a cross sectional view taken along line X-X in FIG. 2.
Figure 5:
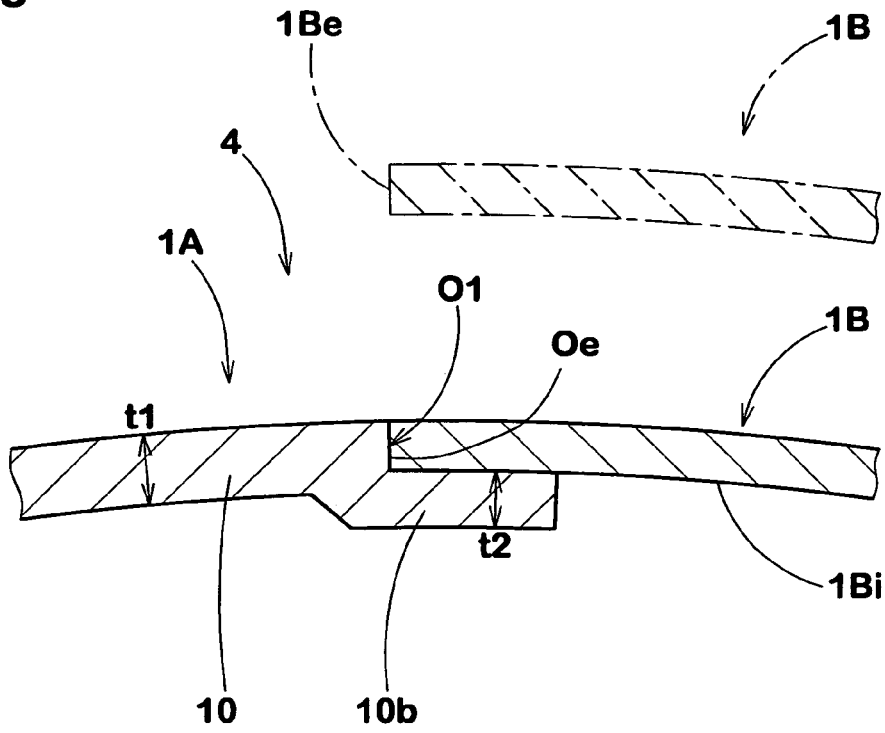
FIG. 5 is an enlarged cross sectional view of the crown plate support.
Figure 6:
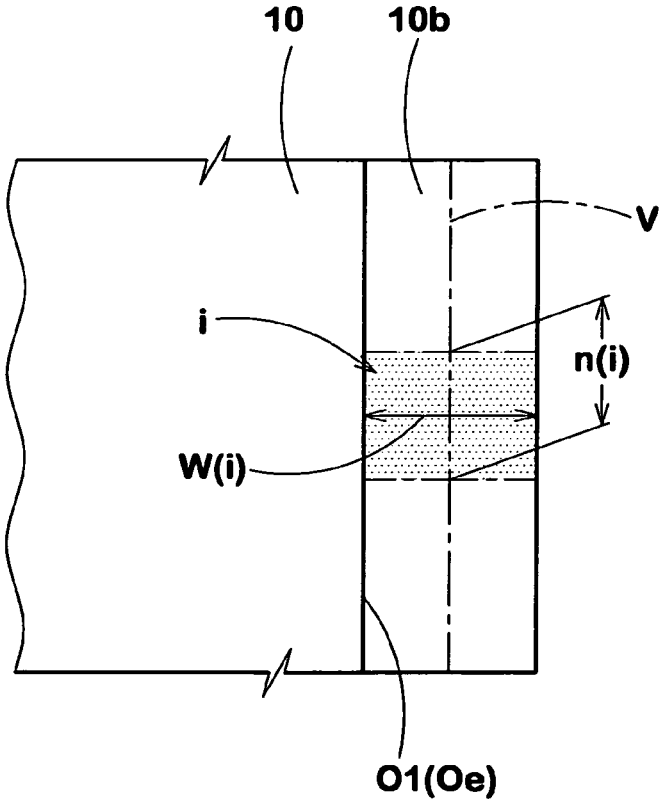
FIG. 6 is an enlarged plan view of the crown plate support for explaining the average width thereof.
Figure 7A:
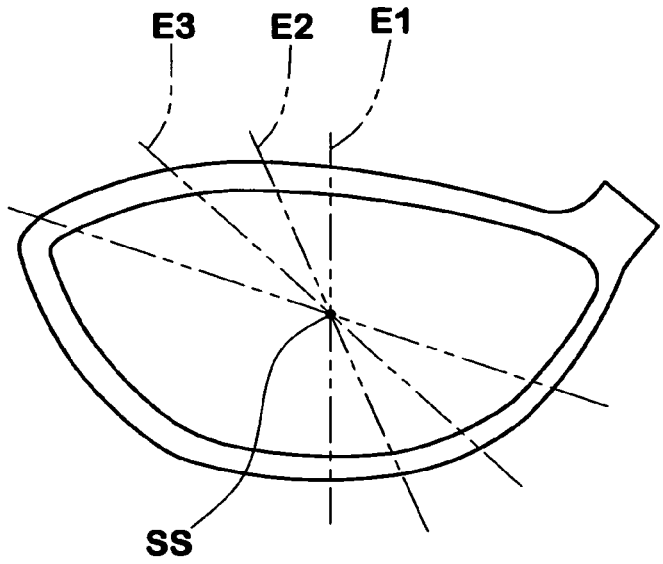
FIG. 7(*a*) and FIG. 7(*b*) are a front view and a crosses sectional view of the face portion for explaining the edge of the club face.
Figure 7B:
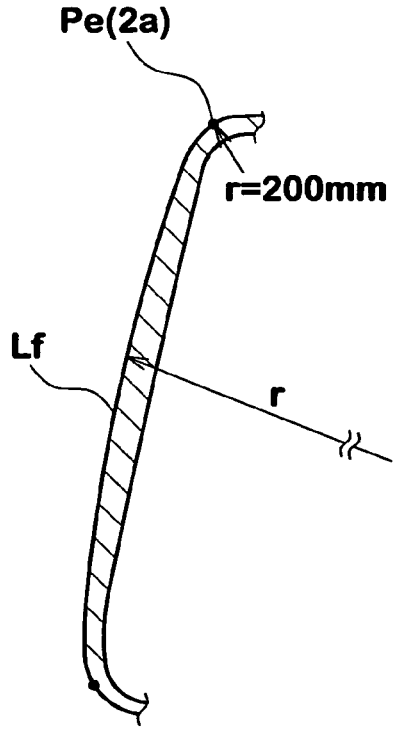

As shown in FIG. 4, along the edge of the front opening O2, there is formed a face plate support 11*b* which dents from the above-mentioned face periphery part 11 and protrudes into the front opening O2 so as to support the edge portion of the face plate 1C. The contour shape of the front opening O2 is almost same as but slightly larger than the contour shape of the face plate 1C. Thus, the face plate 1C is fitted in the front opening O2 such that the circumferential surface of the face plate 1C almost contacts with the inner circumferential surface of the front opening O2, and the periphery part of the inner surface 1Ci of the face plate 1C closely contact with the outer surface of the face plate support 11*b*. The fitted face plate 1C defines a major part of the face portion 3. The amount of dent is such that the outer surface of the face plate 1C becomes flush with the outer surface of the face periphery part 11. In this example, the face plate support 11*b* is formed continuously along the edge of the front opening O2.

As shown in FIG. 3, a crown plate support 10*b* is continuously formed along the edge Oe of the top opening O1. The crown plate support 10*b* dents from the above-mentioned crown periphery part 10 and protrudes into the top opening O1 so as to support the edge portion of the crown plate 1B. The contour shape of the top opening O1 is almost same as but slightly larger than the contour shape of the crown plate 1B. Thus, the crown plate 1B is fitted in the top opening O1 such that the circumferential surface 1Be of the crown plate 1B almost contacts with the inner circumferential surface (Oe) of the top opening O1, and the periphery part of the inner surface 1Bi of the crown plate 1B closely contact with the outer surface of the crown plate support 10*b*. The amount of dent is such that the outer surface of the crown plate 1B becomes flush with the outer surface of the crown periphery part 10.

The thickness t1 of the crown periphery part 10 is set in a range of not less than 0.3 mm, preferably not less than 0.4 mm, more preferably not less than 0.8 mm in order to secure the durability of the crown portion 4. But, in order to avoid undesirable weight increase in the crown portion 4, the thickness t1 is preferably not more than 2.0 mm, more preferably not more than 1.5 mm.

The thickness t2 of the crown plate support 10*b* is equal to or less than the thickness t1 of the crown periphery part 10. But, in order to secure the bonding strength and durability, the lower limit for the thickness t2 is not less than 0.2 mm, preferably not less than 0.3 mm, more preferably not less than 0.5 mm.

According to the present invention, the width of the crown plate support 10*b* is optimized.

The present inventor examined the distribution of the magnitude of stress occurring on the crown plate support 10*b* when hitting a ball, and found that the magnitude becomes smaller in a mid part than the foreside part and backside part, and that the magnitude in the foreside part becomes larger than that in the backside part. Therefore, if the width of the crown plate support 10*b* is decreased in a mid part, it is possible to prevent the bonding strength between the crown plate and head main body and the durability of the head from decreasing, and accordingly, a further weight reduction in the crown portion is possible. Based on this finding, the present inventor studied in order to maximize the weight reduction without deteriorating the bonding strength and durability, and found desirable conditions as follows.

The above-mentioned mid part is a part 14 of the support 10*b* existing on each of the toe-side and heel-side, between a second vertical plane P2 and a third vertical plane P3. The foreside part is a part 13 existing on the club face side of the second vertical plane P2.

The backside part is a part 15 existing on the backside of the third vertical plane P3.

Here, the second vertical plane P2 and third vertical plane P3 are perpendicular to the above-mentioned horizontal plane HP and parallel to the heel-and-toe direction.

The second vertical plane P2 and third vertical plane P3 are positioned backward of the extreme front end (A) of the top opening O1 by distances of ¼ and ¾ of the maximum size L of the top opening O1, respectively.

The maximum size L is a distance in the back-and-forth direction measured between the extreme front end (A) and the extreme rear end (B) of the top opening O1 in the plan view of the head under the standard state. In FIG. 3, P1 and P4 denote vertical planes positioned at the ends (A) and (B)

Firstly, the average width Wa of the foreside part 13, the average width Wb of the mid part 14, and the average width Wc of the backside part 15 are limited to satisfy the following conditional expressions (1) and (2):

$$Wa>Wb \quad (1)$$

$$Wc>Wb \quad (2)$$

Preferably, the average width Wa and average width Wc are further limited to satisfy the following conditional expression (3):

$$Wa>Wc \quad (3)$$

The ratio (Wa/Wb) is preferably not less than 1.2, more preferably not less than 1.5, still more preferably not less than 1.7, but not more than 6.0, more preferably not more than 4.0, still more preferably not more than 3.0.

The ratio (Wc/Wb) is preferably not less than 1.1, more preferably not less than 1.3, but not more than 3.0, more preferably not more than 2.0.

The ratio (Wa/Wc) is preferably not less than 1.1, more preferably not less than 1.3, but not more than 3.0, more preferably not more than 2.0.

If the average width (Wa, Wb, Wc) is too small, then the bonding strength with the crown plate is decreased and the durability is deteriorated. If too large, on the other hand, the weight reduction in the crown portion is spoilt. Therefore, the average width Wa of the foreside part 13 is preferably not less than 2.5 mm, more preferably not less than 3.0 mm, still more preferably not less than 3.3 mm, but not more than 9.0 mm, more preferably not more than 7.0 mm, still more preferably not more than 5.0 mm.

The average width Wc of the backside part 15 is preferably not less than 1.5 mm, more preferably not less than 2.0 mm, still more preferably not less than 2.5 mm, but not more than 5.0 mm, more preferably not more than 4.0 mm, still more preferably not more than 3.0 mm.

The average width Wb of the mid part 14 is preferably not less than 0.5 mm, more preferably not less than 1.0 mm, still more preferably not less than 1.5 mm, but not more than 4.0 mm, more preferably not more than 3.0 mm, still more preferably not more than 2.0 mm. The average width Wb of the mid part 14 on the toe-side is substantially equal to the average width Wb of the mid part 14 on the heel-side.

In each of the foreside, mid and backside parts 13, 14 and 15, it is preferable that the maximum width and minimum width satisfy the above-mentioned limitation for the average width.

It is preferable that the width of the crown plate support 10*b* does not make an abrupt change even in the boundary portions between the foreside, mid and backside parts 13, 14 and 15 as shown in FIG. 3.

Further, it is preferable that the above-mentioned maximum size L of the top opening O1 is set in a range of not less than 30 mm, more preferably not less than 40 mm, still more preferably not less than 50 mm, but not more than 80 mm, more preferably not more than 70 mm, still more preferably not more than 60 mm. If the maximum size L is too small, it becomes difficult to reduce the weight of the crown portion. If too large on the other hand, it becomes difficult to maintain the necessary rigidity for the head main body 1A.

Incidentally, the position of the center of gravity G of the head can be adjusted by changing the thickness distribution of the head main body 1A and/or by disposing a weight member (not shown). In this embodiment, the center of gravity G is positioned between the above-mentioned second vertical plane P2 and the third vertical plane P3.

In this embodiment, the above-mentioned head main body 1A is formed by casting the molten metal material (stainless steel). Thus, the sole portion 5, side portion 6, hosel portion 7, crown periphery part 10, and face periphery part 11 are molded integrally. It is however, also possible to form the head main body 1A by a different process, for example, forging, rolling, bending and the like.

The crown plate 1B and face plate 1C are each made from a rolled plate of a titanium alloy through die press forming. Of course, according to the materials and structures of the head main body 1A, crown plate 1B and face plate 1C, suitable manufacturing methods can be employed aside from the above. These metal parts are assembled as above and connected by means of laser welding for example. Aside from the laser welding, soldering, adhesive bonding, caulking, friction pressure welding, and the like can be employed alone or in combination. Incidentally, the surface of the head, especially the welded part is polished and coated with paint and the like according to need.

Comparison Tests

Hollow metal heads for #1 wood were manufactured and tested for the durability.

Specifications common to all of the heads are as follows.

Other specifications are shown in Table 1.

Head volume: 165 cc
Head weight: 200 grams
Loft angle: 15 degrees
Lie angle: 58 degrees
Size FL of head: 85 mm
Size RL of crown portion: 75 mm
Size L of top opening: 60 mm
Area Sc of crown portion: 65 sq. cm
Area So of crown plate: 58 sq. cm
Ratio (So/Sc): 0.89
Material(specific gravity)
Head main body: casting of SUS450 (7.8)
Face plate: Ti-4.5Al-3V-2Mo-2Fe (4.6)
Crown plate: Ti-15V-3Cr-3Al-3Sn (4.8)

Durability Test:

Each head was attached to a FRP shaft (SRI Sports Ltd. MP-300, Flex R) to make a 45-inch driver, and the golf club was mounted on a swing robot. Then, the head repeatedly hit golf balls at the sweet spot at the head speed of 50 meter/second, while checking the junction between the crown plate and head main body every 100 shots. If damage was observed, the number of shots was recorded. The results are shown in Table 1, using an index based on Ref. 1 being 100, wherein the larger the index number, the better the durability.

TABLE 1

| | Head | | |
|---|---|---|---|
| | Ref. 1 | Ex. 1 | Ex. 2 |
| Average width (mm) of Entirety of Crown plate support | 2.7 | 2.7 | 2.7 |
| Wa of Foreside part 13 | 2.7 | 3.0 | 3.3 |
| Wb of Mid part 14 | 2.7 | 2.0 | 2.0 |
| Wc of Backside part 15 | 2.7 | 3.0 | 2.5 |
| Wa/Wb | 1.0 | 1.5 | 1.7 |
| Wc/Wb | 1.0 | 1.5 | 1.3 |
| Wa/Wc | 1.0 | 1.0 | 1.3 |
| Gravity point height (mm) | 22.5 | 22.8 | 22.6 |
| Lateral moment of inertia (g sq · cm) | 2600 | 2700 | 2650 |
| Vertical moment of inertia (g sq · cm) | 1200 | 1300 | 1250 |
| Durability | 100 | 140 | 190 |

As described above, according to the present invention, in the mid part 14 where the stress at impact becomes smallest, the width of the face plate support is minimized. Therefore, while maintaining the bonding strength, a further weight reduction in the crown portion is possible.

Further, since the foreside part 13 and backside part 15 becomes larger than the mid part 14 in consequence, there is a possibility that the vertical moment of inertia is increased, and thereby the rotational movement of the club head around the horizontal axis when hitting the ball off the sweet spot SS upward or downward, is decreased to stabilize the ballistic courses in the up-and-down direction. Further, there is a possibility that the lateral moment of inertia is increased, and thereby the rotational movement of the club head around the vertical axis when hitting the ball off the sweet spot SS toward the heel or toe, is decreased to stabilize the launch direction of the struck ball.

The present invention is suitably applied to wood-type golf club heads, but it is also possible to apply to other types of heads such as iron-type, utility-type and patter-type as far as they have a hollow structure.

The invention claimed is:

1. A golf club head having a hollow structure comprising:

a head main body provided with a top opening in a crown portion and a crown plate fitted in the top opening so as to close the top opening, wherein the head main body is provided with a crown plate support, the crown plate support extending along an edge of the top opening and protruding into the top opening with a variable width from the edge of the top opening so as to support a peripheral part of an inner surface of the crown plate, wherein an average Wa of a width of the crown plate support existing in a foreside one-quarter zone of the top opening, an average Wc of a width of the crown plate support existing in a backside one-quarter zone of the top opening, and an average Wb of a width of the crown plate support existing in a mid two-quarter zone of the top opening satisfy the following conditional expressions (1) and (2):

$$Wa>Wb \quad (1)$$

$$Wc>Wb. \quad (2)$$

2. The golf club head according to claim 1, wherein the ratio Wa/Wb is from 1.1 to 2.0, and a ratio Wc/Wb is from 1.1 to 2.0.

3. The golf club head according to claim 2, wherein the following conditional expression (3) is further satisfied:

$$Wa>Wc. \quad (3)$$

4. The golf club head according to claim 2, wherein a ratio Wa/Wc is from 1.1 to 3.0.

5. The golf club head according to claim 1, wherein the following conditional expression (3) is further satisfied:

$$Wa>Wc. \quad (3)$$

6. The golf club head according to claim 1, wherein a ratio Wa/Wc is from 1.1 to 3.0.

7. The golf club head according to claim 1, wherein in a plan view of the head, a center of gravity of the head is positioned within said mid two-quater zone of the tope opening.

* * * * *